US005753332A

United States Patent [19]

Hsu

[11] Patent Number: 5,753,332

[45] Date of Patent: May 19, 1998

[54] AIR-PERMEABLE BUFFERING STRUCTURE

[76] Inventor: Wen-Tsung Hsu, No. 250-31, Chung Chou, Chung Sheng Tsun, Jen Te Jsiang, Tainan, Taiwan

[21] Appl. No.: 755,110

[22] Filed: Nov. 22, 1996

[51] Int. Cl.[6] ..... B32B 3/10

[52] U.S. Cl. ..... 428/52; 428/137; 2/16; 2/24

[58] Field of Search ..... 428/52, 137; 2/16, 2/24

[56] References Cited

U.S. PATENT DOCUMENTS 4,884,561 12/1989 Letson ..... 2/24
4,952,436 8/1990 Ruschmann ..... 428/52

FOREIGN PATENT DOCUMENTS 298777 6/1917 Germany ..... 2/16

*Primary Examiner*—Alexander Thomas
*Attorney, Agent, or Firm*—Bacon & Thomas

[57] ABSTRACT

The present invention is related to an air-permeable buffering structure for protecting the body from being hurt while rubbing with a coarse surface. The buffering structure according to the present invention includes a plurality of buffering pads arranged in a stratified way, and a plurality of through holes, each of which is located among several buffering pads for permeating therethrough the air. According to the present invention, the number of the through holes can be up to a great quantity for ensuring sufficient air to permeate therethrough without weakening the buffering structure. In addition, the plurality of buffering pads are arranged in such a particular way so that little things such as gravel will not get into the chink between the body and the buffering structure from the through holes.

4 Claims, 5 Drawing Sheets

AIR-PERMEABLE BUFFERING STRUCTURE

FIELD OF THE INVENTION

The present invention is related to a buffering structure for protecting the body from being hurt while rubbing with a coarse surface, and more particularly to an air-permeable buffering structure for protecting one's knees or elbows.

BACKGROUND OF THE INVENTION

A buffering apparatus for protecting the body from being hurt while rubbing with a coarse surface, e.g. a knee guard or an elbow guard, is generally constructed with a soft air-permeable cushion covered by a plastic buffering structure. As we know, people usually sweat much when they are doing physical exercises. If they are wearing knee guards and/or elbow guards at the time they are doing physical exercises, the location of the body on which the guard is worn is especially subject to perspiring. Referring to FIG. 1, a conventional buffering structure 11 is shown. In this kind of buffering structure 11, there is no air-permeable design provided so that it is difficult for the sweat under the guard to be evaporated if such a guard having a buffering structure shown in FIG. 1 is used. The unevaporated sweat will make the wearer feel uncomfortable.

Accordingly, another buffering structure used in a buffering apparatus and having air-permeable function was commercialized. As shown in FIG. 2, the air-permeable buffering structure 21 is a curved piece of plastic material and includes a plurality of holes 22 directly formed on the curved surface of the buffering structure 21. In order to achieve better effect on air-permeation, the number of the holes 22 required for penetrating air therethrough is generally great and the holes 22 are preferably of a large size. However, the relatively large holes are likely to permit little things such as gravel which might sting the body to enter therefrom. On the other hand, the great number of holes directly formed on the curved surface of the buffering structure is likely to weaken the structure so that the buffering structure is subject to fracture when the location of the body wearing the buffering apparatus has impact against hard stuff or rubs with a coarse surface.

SUMMARY OF THE INVENTION

An object of the present invention is to provide an air-permeable buffering structure including a plurality of buffering pads and a plurality of through holes, wherein the number of the through holes can be up to a great quantity for ensuring sufficient air to permeate therethrough without weakening the buffering structure.

Another object of the present invention is to provide an air-permeable buffering structure including a plurality of buffering pads and a plurality of through holes, wherein the plurality of buffering pads are arranged in a particular way so that the little things such as gravel will not get into the chink between the body and the buffering structure from the through holes.

In accordance with the present invention, an air-permeable buffering structure for protecting the body from being hurt while rubbing with a coarse surface includes a plurality of buffering pads arranged in a stratified way, and a plurality of through holes, each of which is located among several buffering pads for permeating therethrough the air.

The plurality of buffering pads are preferably combined of a fish-scale shape and distributed around the plurality of through holes, and each of the through holes is located among three adjacent buffering pads. More preferably, the plurality of buffering pads are combined to have a curved surface for fitting the curvature of the protected body.

For example, the plurality of buffering pads can be made of plastic material, and they can be integrally formed together with the plurality of through holes by injection molding.

The present invention will be described more detailedly as follows with reference to the accompanying drawings in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for the purpose of illustration and description only; it is not intended to be exhaustive or to be limited to the precise form disclosed.

Figure 1:
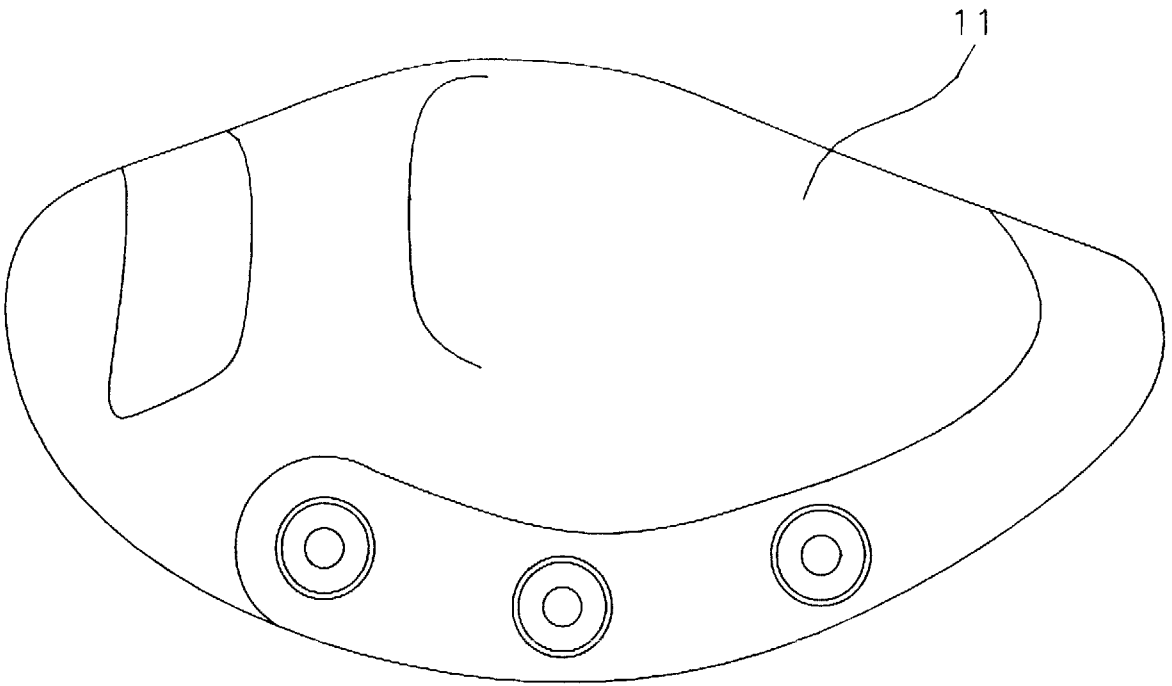
Fig. 1(PRIOR ART)
FIG. 1 is a schematic diagram showing a first conventional buffering structure used in a buffering apparatus.
Figure 2:
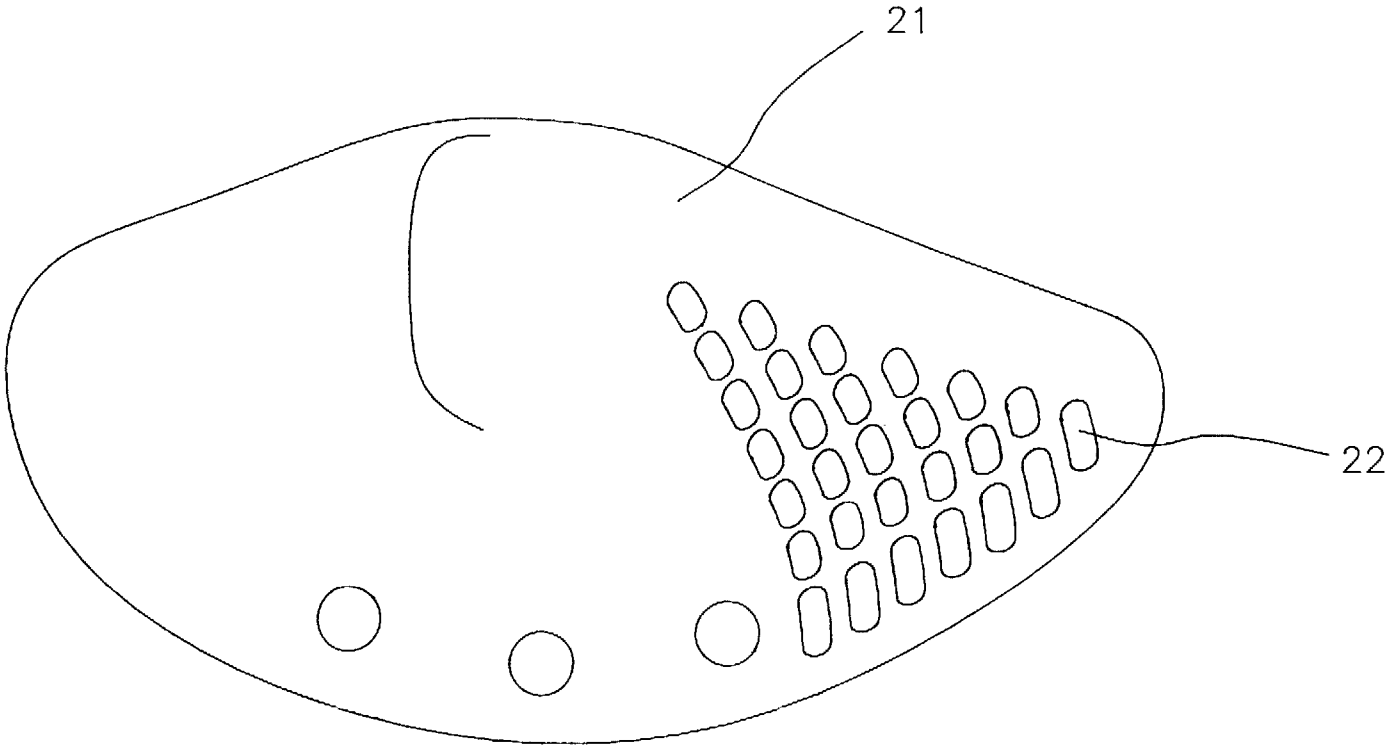
Fig. 2(PRIOR ART)
FIG. 2 is a schematic diagram showing a second conventional buffering structure used in a buffering apparatus.
Figure 3:
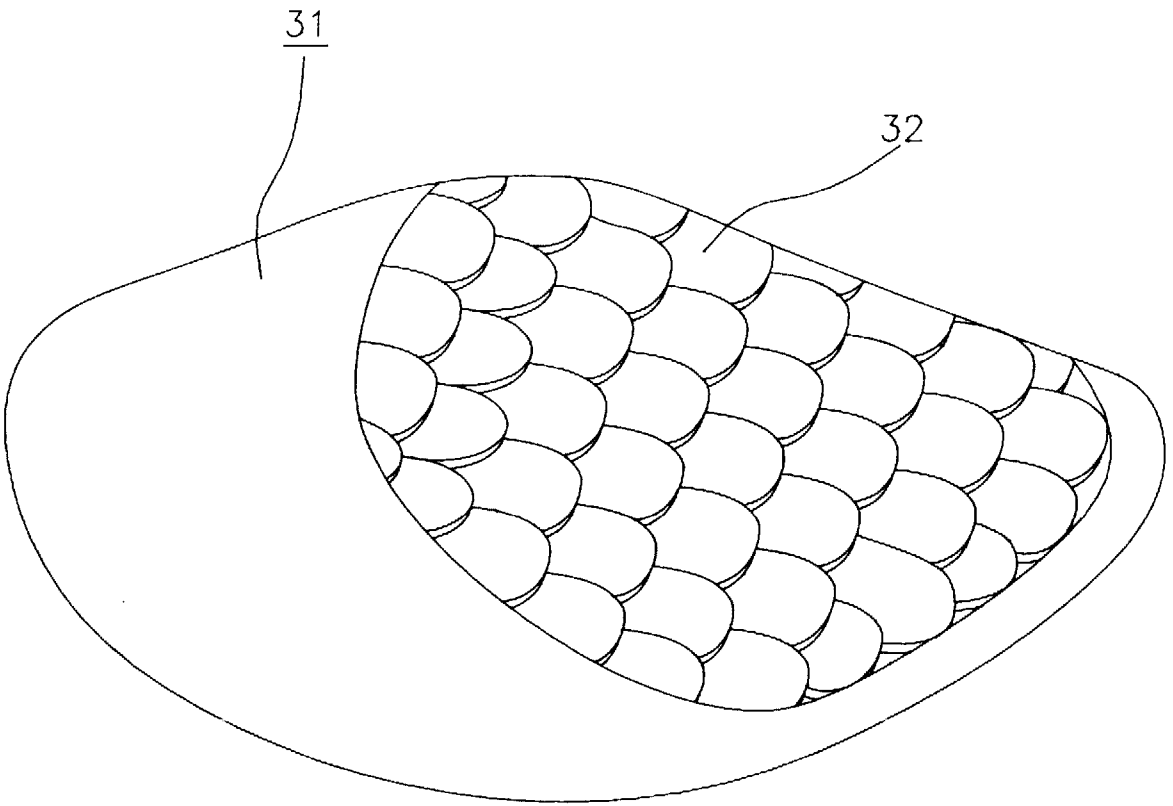
FIG. 3 is a schematic diagram showing a preferred embodiment of a buffering structure according to the present invention.
Figure 4:
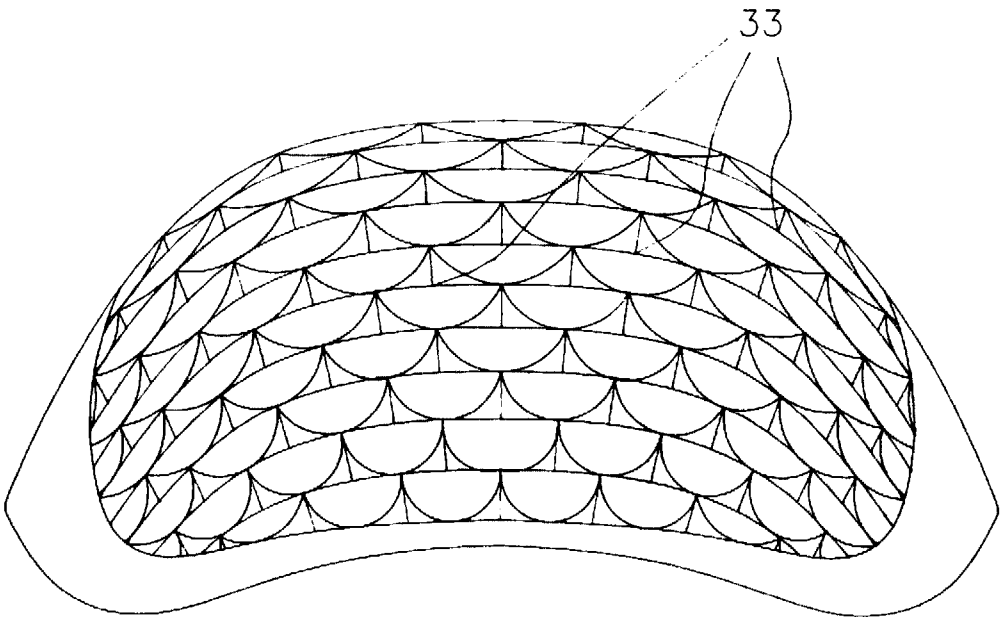
FIG. 4 is a schematic front elevational view of the buffering structure shown in FIG. 3.

Please refer to FIGS. 3 and 4 which are schematic diagrams showing a preferred embodiment of a buffering structure according to the present invention. The buffering structure 31 includes a plurality of buffering pads 32 arranged in a stratified way and a plurality of through holes 33 for permitting the permeation of the air into the chink between the body and the buffering structure 31.

Figure 5:
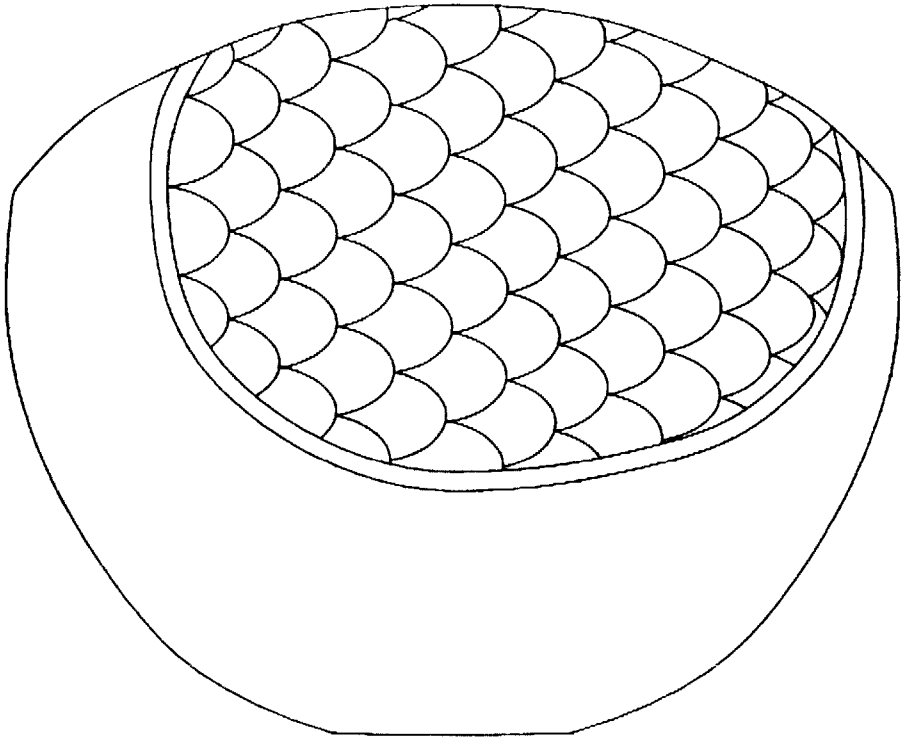
FIG. 5 is a schematic diagram showing another preferred embodiment of a buffering structure according to the present invention.

In this preferred embodiment, the combination of the buffering pads 32 is similar to the arrangement of fish scales and each of the through holes 33 is concealedly located among three stratified scales. In other words, the through holes 33 of this preferred embodiment are simultaneously formed at the time that the buffering pads are produced. The buffering pads are preferably made of plastic material and therefore they can be integrally formed by injection molding. Meanwhile, the buffering structure is made to have a curved surface for fitting the curvature of the location of the body wearing the buffering apparatus such as a knee guard (FIGS. 3 and 4) or an elbow guard (FIG. 5).

The present invention is characterized in that the buffering structure includes a plurality of buffering pads instead of a single piece of plastic material so that the structure according to the present invention is strong enough for forming thereon many air-permeable holes. Furthermore, the buffering pads according to the present invention are arranged in a stratified way so that the through holes can be concealed located among several buffering pads and are not directly exposed to the outside, thereby inhibiting the entrance of little things such as gravel into the chink between the body and the buffering structure.

Of course, the buffering structure is preferably used together with a soft air-permeable cushion located between the body and the buffering structure.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An air permeable buffering structure for protecting a body comprising:

a) a plurality of buffering pads arranged in a plurality of rows, each row having a plurality of buffering pads, the buffering pads of a row overlapping at least portions of the buffering pads of an adjacent row, the buffering pads of alternate rows being laterally displaced from buffering pads of adjacent rows; and, b) a plurality of through holes, each through hole located at a juncture of two adjacent buffering pads of the same row and a buffering pad of an overlapped adjacent row for permeating air therethrough.

2. The air-permeable buffering structure according to claim 1 wherein said plurality of buffering pads form a curved surface for fitting a curvature of the protected body.

3. The air-permeable buffering structure according to claim 1 wherein said plurality of buffering pads are made of plastic material.

4. The air-permeable buffering structure according to claim 3 wherein said plurality of buffering pads and through holes are integrally formed.

* * * * *